United States Patent [19]

Grimmer et al.

[11] 4,154,067

[45] May 15, 1979

[54] CAM SLIDES CAPABLE OF EFFECTING LOOP TRANSFER IN TWO OPPOSITE DIRECTIONS DURING CAM SLIDE TRAVEL IN A SINGLE DIRECTION

[75] Inventors: Eberhard Grimmer, Karl-Marx-Stadt; Klaus Grüssel, Limbach-Oberfrohna; Günther Kessler, Karl-Marx-Stadt, all of Fed. Rep. of Germany

[73] Assignee: Veb Wirkmaschinenbau Karl-Marx-Stadt, Karl-Marx-Stadt, Fed. Rep. of Germany

[21] Appl. No.: 796,721

[22] Filed: May 13, 1977

[30] Foreign Application Priority Data

May 18, 1976 [DE] Fed. Rep. of Germany ..... 0419288

[51] Int. Cl.[2] ..... D04B 7/00; D04B 15/36; D04B 35/00

[52] U.S. Cl. ..... 66/78

[58] Field of Search ..... 66/60, 78, 62, 63, 64, 66/66, 67, 70, 73, 76

[56] References Cited

U.S. PATENT DOCUMENTS

| | | | |
|---|---|---|---|
| 2,705,408 | 4/1955 | Mehnart | 66/64 |
| 2,821,073 | 1/1958 | Mehnert | 66/64 |
| 2,902,846 | 9/1959 | Radhuber | 66/78 X |
| 3,304,748 | 2/1967 | Seiler | 66/64 |
| 3,605,450 | 9/1971 | Goller et al. | 66/78 |
| 3,614,878 | 10/1971 | Mas | 66/78 |
| 3,615,145 | 10/1971 | Goller et al. | 66/78 |
| 3,789,630 | 2/1974 | Schieber et al. | 60/78 |
| 4,012,927 | 3/1977 | Kuhnert | 66/78 |

*Primary Examiner*—Ronald Feldbaum
*Attorney, Agent, or Firm*—Michael J. Striker

[57] ABSTRACT

A knitting machine is comprised of a first pair of cooperating flat needle beds and a second pair of cooperating flat needle beds positioned behind the first. Cam slides are provided with cams for controlling the motions of the needles in the needle beds. The cam slides are mounted for travel in a single direction along a closed path extending around the two pairs of needle beds. At least one, but preferably all, of the cam slides is provided with cam arrangements capable of causing needles to perform normal-knitting motion, loop-delivery motion for loop transfer and also loop-acceptance motion for loop transfer. As the cam slide makes one trip in one direction along one pair of needle beds, it can cause loops to be transferred in both directions during the single trip. When a switchover to normal knitting is to be made, the cam slide need not be replaced but is merely reset for normal knitting.

15 Claims, 3 Drawing Figures

CAM SLIDES CAPABLE OF EFFECTING LOOP TRANSFER IN TWO OPPOSITE DIRECTIONS DURING CAM SLIDE TRAVEL IN A SINGLE DIRECTION

BACKGROUND OF THE INVENTION

The invention relates to the type of knitting machine disclosed in U.S. Pat. Nos. 2,705,408 and 2,821,073, both of whose entire disclosures are incorporated herein by reference. The knitting machine in question includes a first pair of cooperating flat needle beds and a second pair of cooperating flat needle beds arranged behind the first. Cam slides are provided with cams for controlling the motions of the needles in the beds. The cam slides travel in a single direction in a closed path of travel around the two pairs of needle beds.

The present invention relates, in particular, to the performance of loop-transfer operations on such a machine. For loop transfer, a loop on a needle (delivering needle) of one needle bed is to be transferred to the corresponding needle (accepting needle) of the cooperating needle bed.

With knitting machines of the particular type in question, it is already known to use cam slides whose cams cause the needles to perform normal-knitting motions. The cam slides are not capable of causing the needles to perform loop-transfer operations. When loop-transfer is desired, the normal-knitting cam slide is removed and replaced by a special loop-transfer cam slide. This in itself is very inconvenient, and makes completely impracticable the knitting of complicated patterns wherein switchovers between normal-knitting and loop-transfer operation are to be performed at high frequency and in complicated sequences.

Furthermore, the special loop-transfer cam slide is so designed as to include a loop-delivery cam arrangement and a loop-acceptance cam arrangement. However, the construction of these cam arrangements is such that, during loop-transfer operation, the cam slide is only capable of causing loops to be transferred from a predetermined one of the beds of the bed pair to the other bed. The cam slide is not capable of causing loops to be transferred in opposite directions during a single trip of the cam slide along one needle bed pair. This, likewise, greatly limits patterning freedom.

Some years ago, it was proposed to modify the cam slide used on a different type of knitting machine to make the cam slide capable of controlling both normal-knitting and also both types of loop-transfer motion (loop-delivery and loop-acceptance). However, the type of knitting machine involved in that proposal incorporates only a single pair of cooperating needle beds, with the cam slide reciprocating along the length of the needle-bed pair. The cam slide proposed for that type of knitting machine is per se not practicable on the type of knitting machine with which the present invention is concerned. Furthermore, that cam slide was not capable of causing loop transfer to occur in both directions during a single trip of the cam slide in a single direction.

SUMMARY OF THE INVENTION

It is the general object of the present invention to provide novel cam slides for the type of knitting machine disclosed in the aforementioned two U.S. patents. The novel cam slide should be capable of controlling both loop-transfer operations and also normal-knitting.

With respect to loop-transfer, the cam slide should be capable of effecting loop transfer in either direction. Furthermore, the cam slide should be capable of effecting loop transfer in both directions during a single trip of the cam slide in a single direction along one needle-bed pair of the two bed pairs of the knitting machine.

According to one concept of the invention, this is accomplished by providing the cam slide with selecting means for selecting needles for normal knitting, for loop-delivery during loop transfer, and for loop-acceptance during loop transfer, and also cam means operative for causing needles selected for normal knitting to perform a complete normal-knitting motion, for causing needles selected for loop-delivery to perform a complete loop-delivery motion, and for causing needles selected for loop-acceptance to perform a complete loop-acceptance motion.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
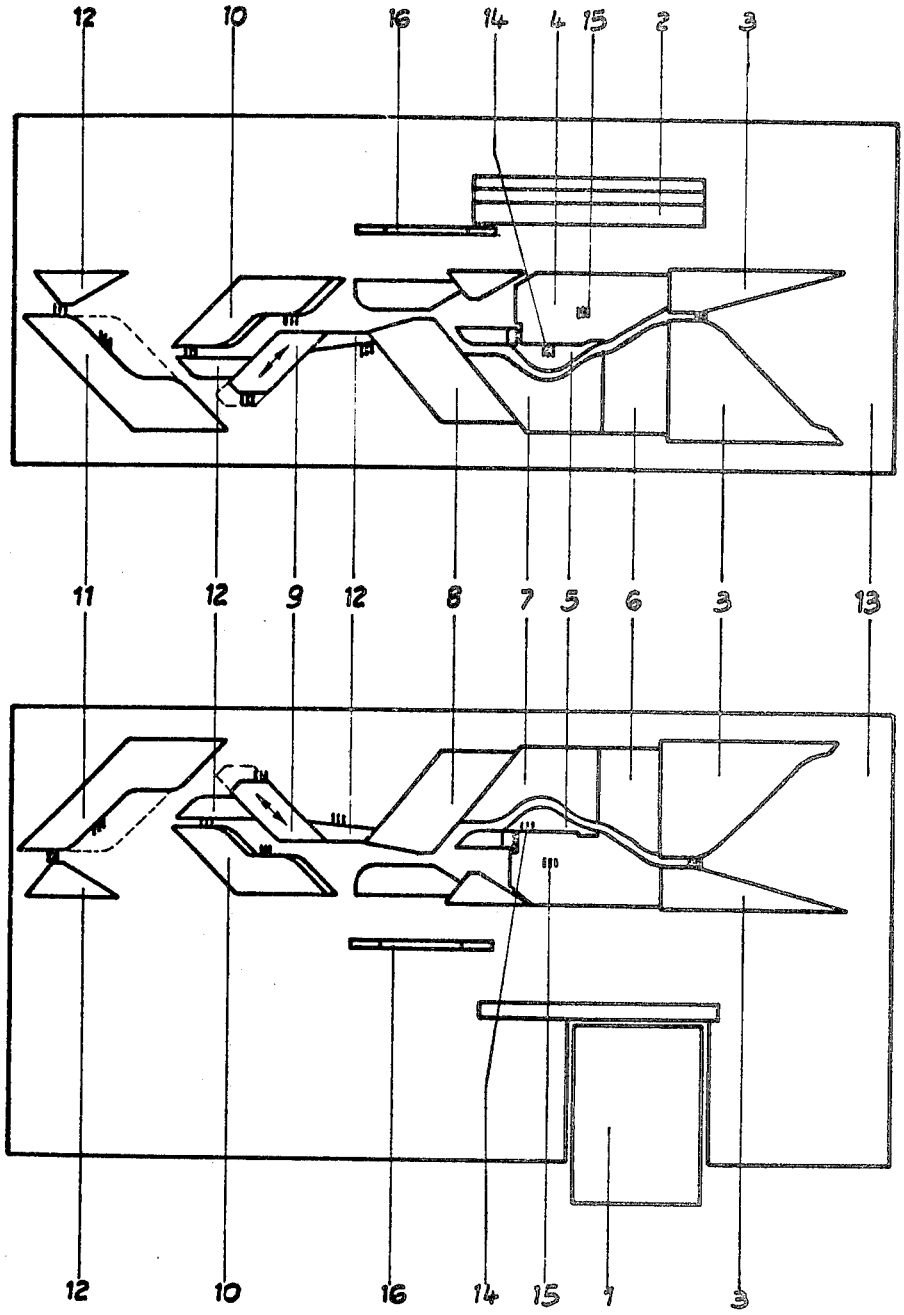
FIG. 1 is a view of a complete cam slide according to the invention.

FIG. 1 depicts an exemplary embodiment of one novel knitting- and loop-transfer cam slide according to the invention. It is to be understood that the cam slide shown in FIG. 1 is used in a knitting machine of the general type disclosed in U.S. Pat. No. 2,705,408, and still more particularly in U.S. Pat. No. 2,821,073, the disclosures of both these patents being incorporated herein by reference.

As shown, for example, in FIG. 5 of U.S. Pat. No. 2,821,073, each such cam slide is mounted on a track for travel in a single direction in a closed path around two pairs of cooperating flat needle beds. One pair of cooperating flat needle beds is located behind the other. Each such cam slide, when travelling along the length of one needle-bed pair controls the motions of the needles in those beds, and then during its return trip along the length of the other needle-bed pair controls the motions of the needles in the beds of the second needle-bed pair.

As shown in FIG. 1, each such cam slide is comprised of two slide plates 13. Each slide plate 13 has mounted thereon a plurality of cams 3–12, the purpose of which will be explained below. The cams 3–12 on the cam slide plate 13, operative for controlling the needles on one bed of a pair of beds (for example the horizontal bed) are mirror-symmetrical with respect to the cams 3–12 on the other slide plate 13, operative for controlling the needles on the other bed of a pair of beds (for example the vertical bed).

For the sake of simplicity, the needle beds and needles are not actually depicted, but are in general the same as disclosed in the aforementioned U.S. Pat. No. 2,821,073.

For convenience, the lower slide plate 13 shown in FIG. 1 is referred to as the vertical slide plate, and the upper slide plate 13 as the horizontal slide plate, in correspondence to the preferred vertical and horizontal orientations of the two beds of each cooperating pair of needle beds.

In FIG. 1, it is to be understood that the illustrated cam slide always moves rightward, with respect to the stationary needle beds along which it moves.

Cams 3 constitute first prepositioning cam means. As the cam slide 13, 13 moves rightward along the needle bed, the butts of all needles are engaged by the prepositioning cam means 3 and are all brought to the illustrated base elevation.

Downstream of the first prepositioning cam means 3 (i.e., leftward of cam means 3 in FIG. 1), is a second prepositioning cam means essentially comprised of cams 4. Cams 4 are operative for raising all needle butts which they engage to a certain level (at which the needle butts 14 as illustrated in FIG. 1 are located). This is the needle-butt level associated with a loop-delivery operation for loop transfer, i.e., all needles selected (as described below) for performance of a loop-delivery operation have their butts engaged by the cams 4 and brought up by the cams 4 to the level shown for the needle butts 14.

In contrast, the butts of those needles selected for loop-acceptance (not loop-delivery) do not have their butts engaged by cams 4. Instead, the butts of these needles are not permitted to come within the operative zone of cams 4. Thus, as the butts of these needles (the ones selected for a loop-acceptance operation) leave the downstream (leftward) end of cams 3 at base elevation, they remain at base elevation as the cams 4 pass by them, and they are not engaged by the cams 4. Numeral 15 denotes the butts of needles selected for a loop-acceptance operation.

To repeat, the butts of all needles are engaged by cams 3 and brought to the base elevation shown in FIG. 1. Thereafter, those needles selected for loop-delivery have their butts engaged by cams 4 and lifted to the level shown for butts 14, whereas those needles selected for loop-acceptance do not have their butts engaged by cams 4, so that these butts pass by cams 4 maintained at the base level, as shown for butts 15.

Whether the needle butts are to be permitted or prevented from being engaged by cams 4 is determined by the needle-selecting means 1, 2.

In FIG. 1, the vertical (lower) slide plate 13 is provided with a pattern drum or wheel 1 operative for selecting needles for normal knitting, for loop-acceptance or for loop-delivery, in accordance with a preselected pattern. The horizontal (upper) slide plate 13 is provided with a functionally equivalent needle-selector mechanism 2, here in the form of a press bar system; in principle, however, a pattern drum or pattern wheel could be used for the second slide plate 13, as well.

The construction and operation of the needle-selecting mechanisms 1 and 2 is based upon conventional knitting machine principles. For example, the pattern drum 1 can be provided with a plurality of circumferentially successive jacks having different settings. The pattern drum 1 can rotate in synchronism with the travel of the cam slide 13, 13 along the pair of needle beds. Each jack, depending upon its setting, can, for example, pivot a needle either to a first position in which its butt will be engaged by cam 4 (butts 14), or else to a second position in which its butt will not be engaged by cam 4 (butts 15). The settings of the jacks on the pattern drum 1 can be changed, for example once per complete trip of the cam slide 13, 13 about its closed path of travel, by means of a stationary jacquard mechanism, for example as shown in U.S. Pat. No. 2,821,073 mentioned above.

The operation of the needle-selecting mechanism 2 for the horizontal (upper) slide plate 13 is functionally equivalent.

The cams 6 are safety cams, provided to prevent excessive lifting of the needle butts by the cams 4.

Located downstream (leftward) of the lifting faces of prepositioning cams 4, are raising cams 5 for normal knitting. Needles selected for normal knitting have their butts engaged by raising cams 5 and lifted, so that these needles will perform the conventional rising motion for normal knitting.

In contrast, in FIG. 1, the butts of these needles selected for loop-transfer (whether loop-delivery or loop-acceptance) do not have their butts engaged by raising cams 5. The needles selected for loop-acceptance anyway cannot be engaged by raising cams 5, because their butts 15 have not been lifted by cams 4 into the range of raising cams 5. In contrast, the needles selected for loop-delivery are raised by prepositioning cams 4 to the height of the upstream (rightward) ends of cams 5. However, the needle-selecting means 1, 2 displaces the needles selected for loop-delivery in such a manner that their butts 14 pass by raising cams 5 and are not engaged by raising cams 5.

Numeral 8 denotes the lowering cams for normal knitting. Needles which have been selected for normal knitting motion have had their butts raised by raising cam 5 for the conventional rising motion of normal knitting. Thereafter, they have their butts lowered by lowering cam 8 for the conventional lowering motion of normal knitting.

The butts 15 of the needles selected for loop-acceptance move past prepositioning cams 4 unaffected (as already stated), and continue to travel, still at the height established by cams 3, through the cam system, unaffected by the cams along the way, until they reach the loop-acceptance cams 10 (discussed further below). In particular, the butts 15 of the needles selected for loop-acceptance are at such a height that they cannot be engaged by the normal-knitting lowering cams 8.

In contrast, the butts 14 of the needles selected for loop-delivery are brought by prepositioning cams 4 to such a height that, if countermeasures were not taken, these butts 14 could be (undesirably and improperly) engaged by the normal-knitting lowering cams 8. To prevent this, each slide plate 13 is provided with a controllable override cam 16. Each override cam 16 has an operative and also a retracted, inoperative setting. When the override cam 16 is in the operative setting, it displaces the needles selected for loop-delivery in such a way that their butts 14 are displaced (e.g., transversely) out of the operative zone of normal-knitting lowering cams 8. Accordingly, these butts 14, although at a height where they could be engaged by cams 8, move past cams 8 unaffected. To repeat, this occurs when the override cams 16 are in their operative settings.

The override cams 16 will be in their inoperative setting when the cam slide 13, 13 has been set up for normal knitting only. Deactivation of override cams 16 for normal knitting is necessary, so that cams 16 will not prevent needles selected for normal knitting from being engaged by the lowering cam 8.

The control of the setting (operative or inoperative) of override cams 16 can be performed in various ways. In principle, the settings of cams 16 could be changed manually. However, for complicated effects, it may be necessary to alternately set up the cam slide 13, 13 for normal-knitting and for loop-transfer quite frequently. For example, it may be desired that the cam slide 13, 13 performs one complete trip around the two needle-bed pairs set up for loop-transfer control, and then during its next complete trip be set up for normal knitting. In that event, the setting of override cams 16 can be controlled by a stationary pattern-controlled trip means (or the like) which the cam slide 13, 13 passes over once per complete trip around its closed path of travel.

To repeat, the butts 15 of needles selected for loop-acceptance are at such a height that they pass by normal-knitting lowering cams 8 unaffected. In contrast, the butts 14 of needles selected for loop-delivery are at such a height that the override cams 16 must displace these needles, during their travel past cams 8, in such a way that their butts 14 are moved (e.g., transversely) out of the operative zone of lowering cams 8.

Cams 7 are additional safety cams. They prevent the butts of needles raised by the normal-knitting raising cams 5 from being raised too high.

Discussing now only the needles selected for loop-transfer, the butts 14 of the needles selected for loop-delivery travel through the cam system until they reach the loop-delivery cams 9. Likewise, the butts 15 of the needles selected for loop-acceptance travel through the cam system until they reach the loop-acceptance cams 10. When the butts 14, 15 reach the loop-transfer cams 9, 10, they are caused to perform appropriate loop-delivery and loop-acceptance motions.

In particular, the butts 14 of the needles selected for loop-delivery are raised by loop-delivery cams 9 into loop-delivery height. The butts 15 of the corresponding needles on the respective other needle bed selected for loop-acceptance are raised by loop-acceptance cams 10 to a lesser height, such that the loop-acceptance needles poke into expanded loops of the loop-delivery needles (the ones with butts 14). By virtue of the configuration of loop-delivery cams 9, the loop-delivery needles (with butts 14) move into a somewhat lower height, somewhat relaxing their loops.

The needle butts 14, 15 then remain unchanged in height for a short dwell time, until they reach retracting cams 11, which retract these butts back down to the base elevation (the same butt elevation established by prepositioning cams 3).

Cams 12 are additional safety cams.

As explained above, it is preferred that override cams 16 be controllable cams, controlled by stationary pattern-controlled trip means (or the like) on the knitting machine, with the setting of override cams 16 being changed (or maintained) each time the cam slide 13, 13 passes over the stationary trip means.

In contrast, it is preferred that loop-delivery cam 9 not be such a controllable or switchable cam, but instead merely be an adjustable cam, adjustable in position in the sense indicated by the double-headed arrow. This makes it possible for the adjusting mechanism for loop-delivery cam 9 to be very simple and inexpensive (e.g., essentially comprised of adjusting screws or the like), with no switching or control action for cam 9 then being required.

The retracting cams 11 as shown in FIG. 1 are provided with a controllable cam section (shown in broken lines), for changing the effective shape of cams 11. If it is desired to differentiate in time between the retraction of loop-delivery needles and the retraction of loop-acceptance needles, the controllable cam section of cam 11 is switched back and forth between operative and inoperative position. The controllable cam sections of the two cams 11 will alternately be in operative position; i.e., when one is in operative position the other will be in inoperative position, and vice versa.

As explained above, in FIG. 1, it is the controllable override cams 16 which cause the butts 14 of needles selected for loop-delivery to bypass the normal-knitting lowering cams 8. Alternative override or bypass mechanisms are depicted in FIGS. 2 and 3.

Figure 2:
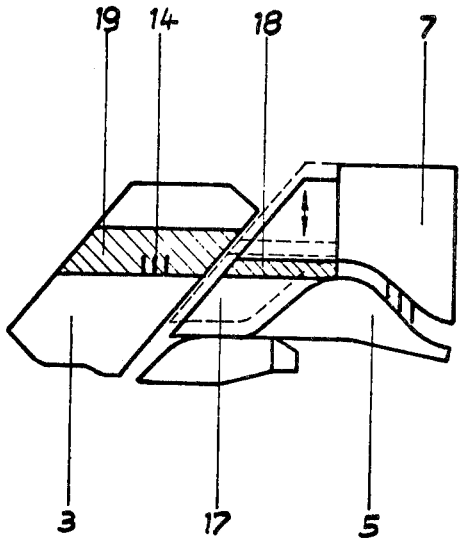
FIG. 2 is a view of a part of a similar but modified cam slide.

In FIG. 2, the safety cam 7 of FIG. 1 is divided into two parts, a stationary part and also a switchable part 17. Switchable cam part 17 is preferably controlled in the same way as controllable override cams 16 in FIG. 1. The switchable cam part 17 is provided with a through-pass channel 18. In this embodiment, butts 14 of needles selected for loop-delivery are permitted to strain raising cam 5. However, for these needles, switchable cam section 17 is moved from its normal (broken-line) position to its bypass (solid-line) position. Accordingly, the butts 14 of needles selected for loop-delivery are not lowered by cam section 17, but instead pass through channel 18. Thereafter, they pass through a channel 19 provided in the lowering cam 8, so as not to be lowered by cam 8.

Figure 3:
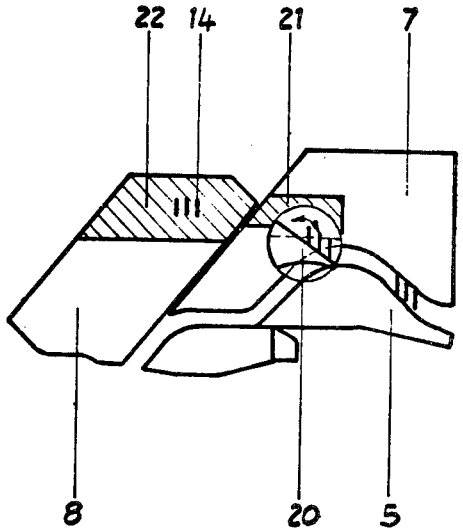
FIG. 3 is a view of a part of a similar but differently modified cam slide.

Another possibility is depicted in FIG. 3, Here, the safety cam 17 is again provided with a switchable cam section, in the form of a rotatable section 20. When rotated into its solid-line position, section 20 prevents the butts 14 from being lowered by cam 7, and instead guides them through a recess 21 in cam 7, after which they pass through a recess 22 in lowering cam 8, so as not to be lowered by lowering cam 8. Accordingly, the butts 14 can thereafter travel to the loop-delivery cam 9.

Further variations would also be possible. For example, the cam 8 can be prevented from lowering butts 14 by shifting cam 8 upward, so that its lowermost portion at least clears the level of butts 14; the safety cam (no reference numeral) cooperating with shifting cam 8 could be shifted upward likewise, so that these two cams would form a channel for butts 14 to pass through. Alternatively, a switchable baffle could be located in the region of the raising cam 5.

With the constructions described above, as the cam slide makes a single trip in a single direction along the length of one needle-bed pair, it is capable of causing loops to be transferred in both directions, i.e., from one bed to the other and vice versa. This is a novel capability. Furthermore, the cam slide is so designed that, if a switchover from loop-transfer operation to normal-knitting is desired, the cam slide need not be replaced. Accordingly, it is advantageous to have all the cam slides of the knitting machine designed in the novel way.

It will be understood that each of the elements described above, or two or more together, may also find a useful application in other types of constructions, differing from the types described above.

While the invention has been illustrated and described as embodied in a cam system of particular configuration, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a flat-bed knitting machine of the type comprised of a first pair of cooperating flat needle beds containing oppositely located corresponding needles and a second pair of cooperating flat needle beds likewise containing oppositely located corresponding needles, each needle being provided with an activating portion, the activating portions of all the needles being located at the same height relative to the length of the needles, the second needle bed pair being arranged behind the first needle bed pair, a plurality of cam slides controlling the motion of the needles in the needle beds, and means transporting the cam slides in a single direction along a closed path of travel around the two pairs of needle beds, at least one of the cam slides being provided with needle-selecting means operative in accordance with a preselected pattern for selecting corresponding needles on a needle bed pair for respective loop-delivery and loop-acceptance motion and for normal-knitting motion;

said at least one cam slide furthermore being provided with cam means operative for causing corresponding needles on a needle bed pair selected for respective loop-delivery and loop-acceptance motion to perform such motion and for causing needles selected for normal knitting to perform normal-knitting motion, the cam means comprising prepositioning cam means operative for engaging needle-activating portions and bringing such portions of all needles to a first level, downstream of the prepositioning cam means normal-knitting raising cam means followed by normal-knitting lowering cam means operative for engaging the activating portions of needles selected for normal-knitting motion and causing such needles to perform a normal-knitting rising motion and then a normal-knitting lowering motion, downstream of the normal-knitting cam means loop-delivery raising cam means operative for engaging needle-activating portions of needles selected for loop delivery and causing such needles to perform a loop-delivery rising motion, likewise downstream of the normal-knitting cam means loop-acceptance raising cam means operative for engaging needle-activating portions of needles selected for loop acceptance and causing such needles to perform a loop-acceptance rising motion, downstream of the loop-delivery and loop-acceptance raising cam means loop-transfer lowering cam means operative for engaging needle-activating portions of needles selected for loop-delivery and loop-acceptance and causing such needles to respectively perform a loop-delivery lowering motion and a loop-acceptance lowering motion, the height of at least part of the camming surface of at least one of the normal-knitting cam means being such relative to the height of the camming surface of the loop-delivery raising cam means that, if countermeasures were not taken, the activating portions of needles selected for loop delivery would be engaged by said camming surface part and be moved to a height such that they could not then be properly engaged by the camming surface of the loop-delivery raising cam means;

said at least one cam slide furthermore being provided with switchable control means switchable between an operative and an inoperative setting, the switchable control means when in the operative setting preventing the activating portions of needles selected for loop delivery from being thusly engaged and moved by said camming surface part, thereby assuring that when the activating portions of such needles reach the loop-delivery raising cam means their activating portions will be properly engaged and raised by the camming surface of the loop-delivery raising cam means.

2. In a knitting machine as defined in claim 1, said camming surface part being at least part of the camming surface of the normal-knitting lowering cam means.

3. In a knitting machine as defined in claim 1, the loop-delivery raising cam means having a raising camming surface followed by a recessed surface, whereby when the activating portions of needles selected for loop delivery have been raised by the raising camming surface and then reach the recessed surface they cease to be guided from below at the level of the raising cam surface and the loops they carry can detension.

4. In a knitting machine as defined in claim 3, the loop-transfer lowering cam means having a lowering camming surface spaced downstream from the loop-delivery raising cam means and the loop-acceptance raising cam means, whereby when the latter two cam means pass by needles selected for loop transfer those needles remain at approximately constant height for at least a part of the time elapsing before their activating portions are reached by the camming surface of the loop-transfer lowering cam means.

5. In a knitting machine as defined in claim 4, the loop-transfer lowering cam means having a lowering camming surface positioned such that when it begins to engage the activating portion of a needle selected for loop delivery it simultaneously begins to engage the activating portion of the corresponding needle of the cooperating bed selected for loop acceptance and lowers the two needles simultaneously.

6. In a knitting machine as defined in claim 4, the loop-transfer lowering cam means having a fixed part and a switchable part, the switchable part having a first, a second and a third setting, the loop-transfer lowering cam means when its switchable part is in the first setting simultaneously engaging and then lowering corresponding needles respectively selected for delivery and acceptance, the loop-transfer lowering cam means when its switchable part is in the second setting first engaging a needle selected for loop delivery and only thereafter engaging the corresponding needle selected for loop acceptance and lowering the former with a lead relative to the latter, the loop transfer lowering cam means when its switchable part is in the third setting first engaging a needle selected for loop acceptance and only thereafter engaging the corresponding needle selected for loop delivery and lowering the former with a lead relative to the latter.

7. In a knitting machine as defined in claim 2, the loop-delivery raising cam means being a vertically adjustable but non-switchable cam means.

8. In a knitting machine as defined in claim 1, the switchable control means comprising switchable cam means operative for transversely displacing the activating portions of needles selected for loop delivery.

9. In a knitting machine as defined in claim 2, the switchable control means comprising safety cam means cooperating with the normal-knitting raising cam means, the safety cam means including a switchable part having a first and a second setting, the safety cam means when its switchable part is in the first setting cooperating with the camming surface of the normal-knitting raising cam means to form a guide channel for activating portions of needles selected for normal knitting, the safety cam means when its switchable part is in the second setting diverting the activating portions of needles selected for loop delivery along a path which does not intersect the lowering camming surface of the normal-knitting lowering cam means, whereby needles selected for loop delivery will not be lowered by the normal-knitting lowering cam means.

10. In a knitting machine as defined in claim 9, the switchable part of the safety cam means being a rotary part rotatable between the first and second setting, the rotary part when in said second setting forming together with the remainder of the safety cam means a channel which includes said path.

11. In a knitting machine as defined in claim 9, the normal-knitting lowering cam means having a transverse setback, said path extending through said setback.

12. In a knitting machine as defined in claim 9, the normal-knitting lowering cam means having a recess, said path extending through said recess.

13. A method of controlling the motions of needles in a flat-bed knitting machine, the machine being of the type comprised of a first pair of cooperating flat needle beds containing oppositely located corresponding needles and a second pair of cooperating flat needle beds likewise containing oppositely located corresponding needles, each needle being provided with an activating portion, the activating portions of all the needles being located at the same height relative to the length of the needles, the second needle bed pair being arranged behind the first needle bed pair, a plurality of cam slides, and means transporting the cam slides in a single direction along a closed path of travel around the two pairs of needle beds, the method comprising the steps of using pattern-dependent needle-selecting means on at least one of the cam slides to make pattern-dependent selections of needles for loop-delivery motion and of corresponding needles for loop-acceptance motion and of needles for normal-knitting motion;

using prepositioning cam means on said cam slide to engage the needle-activating portions of all needles passed by the cam slide and bring such portions of all needles passed by the cam slide to a first level, using normal-knitting raising cam means, located on said cam slide downstream of the prepositioning cam means, for engaging the activating portions of all needles selected for normal-knitting motion and causing such needles to perform a normal-knitting rising motion, using normal-knitting lowering cam means, located on said cam slide downstream of said raising cam means, for engaging the activating portions of all needles selected for normal-knitting motion and causing such needles to perform a normal-knitting lowering motion, using loop-delivery raising cam means, located downstream of the noraml-knitting cam means, to engage the needle-activating portions of needles selected for loop delivery and cause such needles to perform a loop-delivery rising motion, using loop-acceptance raising cam means, likewise located downstream of the normal-knitting cam means, to engage the activating portions of needles selected for loop acceptance and cause such needles to perform a loop-acceptance rising motion;

lowering needles selected for loop delivery and the corresponding needles selected for loop acceptance when these needles are passed by the loop-delivery and loop-acceptance raising cam means;

the height of at least part of the camming surface of at least one of the normal-knitting cam means being such relative to the height of the camming surface of the loop-delivery raising cam means that, if countermeasures are not taken, the activating portions of needles selected for loop delivery would be engaged by said camming surface part and be moved to a height such that they could not then be properly engaged by the camming surface of the loop-delivery raising cam means, the method furthermore including the step of guiding the activating portions of the needles selected for loop delivery past said camming surface part without being thusly engaged and moved by said camming surface part, whereby to assure that when the activating portions of such needles reach the loop-delivery raising cam means their activating portions will be properly engaged and raised by the camming surface of the loop-delivery raising cam means.

14. The method defined in claim 13, after the loop-delivery and loop-acceptance cam means have passed a pair of corresponding needles, one of which has been selected for loop delivery and the other for loop acceptance, lowering the corresponding needles simultaneously.

15. The method defined in claim 13, after the loop-delivery and loop-acceptance cam means have passed a pair of corresponding needles, one of which has been selected for loop delivery and the other for loop acceptance, lowering the two corresponding needles, but beginning the lowering of one of the needles prior to the beginning of the lowering of the other.

* * * * *